United States Patent [19]

Mizushima

[11] Patent Number: 4,835,803

[45] Date of Patent: Jun. 6, 1989

[54] PROCESS FOR PRODUCING A SHAPE-MEMORIZING WOOL AND ANIMAL HAIR

[76] Inventor: Shigesaburo Mizushima, Ishikawa, Japan

[21] Appl. No.: 76,189

[22] Filed: Jul. 21, 1987

[30] Foreign Application Priority Data

Jul. 24, 1986 [JP] Japan ..... 61-174254

[51] Int. Cl.[4] ..... D06M 3/02

[52] U.S. Cl. ..... 8/128.1; 8/127.51; 424/72; 132/7

[58] Field of Search ..... 8/127.51, 128 R; 424/72; 132/7

[56] References Cited

U.S. PATENT DOCUMENTS 3,151,439 10/1964 Dusenbury ..... 8/128 R 3,466,136 9/1969 Wasley et al. ..... 8/128 R 3,957,065 5/1976 Busch et al. ..... 424/72

4,041,150 8/1977 Karjala ..... 424/72

*Primary Examiner*—Robert A. Wax

*Attorney, Agent, or Firm*—Wenderoth, Lind & Ponack

[57] ABSTRACT

This invention relates to a process for producing permanently waved wool and animal hair. In addition to providing a process for waving wool and animal hair, the process of the present invention improves the elasticity of these natural fibers. Yarns with better elasticity and expansibility and with sufficient swelling property can be obtained after spinning.

When woven or knitted, a produce with a lower specific weight with better elasticity and expansibility and with better anti-shrinking and anti-inflammatory properties can be obtained.

4 Claims, No Drawings

PROCESS FOR PRODUCING A SHAPE-MEMORIZING WOOL AND ANIMAL HAIR

BACKGROUND OF THE INVENTION

Natural sheep wool and animal hair have higher elasticity than other fibers, but techniques exist by which is is possible to wave and to increase the elasticity of these fibers. Resin treatment has been used in an attempt to maintain the elasticity of fibers.

In practical application, however, the effect of waving is reduced and the elasticity is gradually decreased when the wool and animal hair are spun, knitted and woven and the yarns or fabrics thus produced are washed several times.

SUMMARY OF THE INVENTION

Wool and animal hair are composed of keratin, which is in turn composed of more than a dozen amino acids. Major components of these amino acids are: cystine 13.1%, glutamic acid 12.9%, leucine 11.5%, algin 10.2%, tristidine 6.9%, tyrosine 4.8%, alanine 4.4%, proline 4.4%, etc. These components are connected to each other in a chain by cystine bonds. By cleaving cystine bonds chemically or by adding quanidine or keratin to the components contained in wool and animal hair and by adding artificially produced waves in addition to their natural waves, and by increasing those components which are relatively low in wool and animal hair such as alanine, which exists in quantity in fibroin (silk component), (34.37%), glycine (42.6%), serine (15.03%), tyrosine (11.29%), etc. and by bonding them together by using an oxidizing agent such as hydrogen peroxide, a product having higher elasticity than conventionally prepared wool and animal hair and having additional waves is obtained. The product is also improved with respect to swelling, anti-shrinking, and bulkiness.

The purpose of the present invention is, therefore, to produce permanently waved wool and animal hair having excellent properties such as permanent elasticity, anti-shrinking, swelling, etc. by treating them with a solution of protein derived from fibroin, keratin or collagen.

DETAILED DESCRIPTION OF THE INVENTION

The process of the present invention will be illustrated by the following embodiments:

Slivers of wool and animal hair are steamed, subjected to artificial crimping, and then immersed in a 5 to 7% solution of ammonium thioglycollate for 10 to 20 minutes at 35° to 40° C. The slivers are washed with water to which has been added 5% solutions of guanidine carbonate or guanidine phosphate, and 5% solution of collagen protein, keratin protein or fibroin protein. After 10 minutes, it is treated with a 1% solution of hydrogen peroxide, and after the crimping means is removed, the fibers are washed and dried. The process results in permanently waved tool and animal hair having improved elasticity, swelling and anti-inflammatory properties.

Yarn which is produced from fibers which are treated according to the present invention is characterized by elasticity and swelling properties which are 10 to 30% better after spinning than conventionally treated fibers. When woven, the products are 10 to 30% higher in elasticity and knitted products are 20 to 30% higher in elasticity than conventional products. The fibers which are treated according to the present invention are lower in specific weight and suitable for dyeing. The products are superbly suited for producing woven fabrics, knitwork, etc..

What is claimed is:

1. A process for permanently waving the fibers of wool and animal hair, comprising the sequential steps of (a) subjecting said fibers to steam, (b) crimping the steamed fiber by crimping means, (c) contacting the crimped fibers with a reducing agent whereby cystine bonds are cleaved and washing the cleaved fibers with water, (d) modifying the cleaved fibers by contacting with an aqueous solution of guanidine carbonate or guanidine phosphate, and protein derived from collagen, keratin or fibroin and washing the modified fibers with water, (e) contacting the modified fibers with an oxidizing agent and removing said crimping means.

2. A process according to claim 1 wherein said protein is derived from collagen.

3. A process according to claim 1 wherein said protein is derived from keratin.

4. A process according to claim 1 wherein said protein is derived from fibroin.

* * * * *